US007121122B2

(12) United States Patent
Levi

(10) Patent No.: US 7,121,122 B2
(45) Date of Patent: Oct. 17, 2006

(54) STRAP LOCK

(76) Inventor: Clark Levi, 3333 Pine Cir., Ocean Springs, MS (US) 39564

( * ) Notice: Subject to any disclaimer, the term of this patent is extended or adjusted under 35 U.S.C. 154(b) by 81 days.

(21) Appl. No.: 10/352,100

(22) Filed: Jan. 28, 2003

(65) Prior Publication Data

US 2003/0164009 A1 Sep. 4, 2003

Related U.S. Application Data

(63) Continuation-in-part of application No. 09/612,940, filed on Jul. 10, 2000, now Pat. No. 6,510,717.

(51) Int. Cl.
*E05B 73/00* (2006.01)

(52) U.S. Cl. ..... 70/18; 70/57; 70/30; 70/49; 24/170

(58) Field of Classification Search ..... 70/14, 70/18, 19, 30, 49, 57; 24/170, 191
See application file for complete search history.

(56) References Cited

U.S. PATENT DOCUMENTS 3,161,258 A * 12/1964 Chapman ..... 181/287
3,592,028 A * 7/1971 Monica ..... 70/57
3,875,771 A * 4/1975 Reisner ..... 70/18
4,282,730 A * 8/1981 Lipschutz ..... 70/184
4,392,902 A * 7/1983 Lefferts ..... 156/161
4,505,140 A * 3/1985 Solow ..... 70/424
4,685,315 A * 8/1987 Comolli ..... 70/68
4,860,408 A * 8/1989 Johnson ..... 24/68 CD
4,887,660 A * 12/1989 Kraus ..... 160/265
5,104,724 A * 4/1992 Hsu ..... 428/222
5,177,986 A * 1/1993 Jensen ..... 70/18
5,205,021 A * 4/1993 Durand ..... 24/163 R
5,362,282 A * 11/1994 Lickton ..... 474/220
5,369,970 A * 12/1994 Voiculescu et al. ..... 70/240
5,582,046 A * 12/1996 Baumwoll et al. ..... 70/237
5,669,253 A * 9/1997 Higgins ..... 70/18
5,692,403 A * 12/1997 Ling ..... 70/312
5,706,679 A * 1/1998 Zane et al. ..... 70/18
5,731,059 A * 3/1998 Smith et al. ..... 428/192
6,044,669 A * 4/2000 Levi ..... 70/18
6,067,662 A * 5/2000 Sim ..... 2/339
6,199,412 B1 * 3/2001 Kennedy ..... 70/18
6,206,138 B1 * 3/2001 Yerger ..... 182/136
6,430,974 B1 * 8/2002 Mitchell et al. ..... 70/18
6,435,101 B1 * 8/2002 Marker et al. ..... 105/15
6,446,474 B1 * 9/2002 Tabacchi et al. ..... 70/16
6,510,717 B1 * 1/2003 Levi ..... 70/18
6,578,394 B1 * 6/2003 Yin ..... 70/58

* cited by examiner

*Primary Examiner*—Suzanne Dino Barrett
(74) *Attorney, Agent, or Firm*—Austin Bonderer

(57) ABSTRACT

A strap lock has a flexible strap having a leading end and a trailing end. A locking device includes a first strap engagement portion that is capable of holding one part of the strap in position with respect to the locking device in a lock position thereof, and releasing the one part of the flexible strap in a release position. A second strap engagement portion engages another part of the flexible strap. A lock is capable of locking the first strap engagement portion in the lock position. The strap is preferably woven from strands of metal and high strength polymer.

12 Claims, 20 Drawing Sheets

STRAP LOCK

REFERENCE TO RELATED APPLICATION

This is a continuation-in-part of U.S. application Ser. No. 09/612,940, filed Jul. 10, 2000 now U.S. Pat. No. 6,510,717. The entire contents of application Ser. No. 09/612,940 are incorporated herein by reference.

BACKGROUND OF THE INVENTION

1. Field of the Invention

The present invention relates to securing devices used for locking items such as bicycles. In particular, the present invention relates to flexible and variably sized strap-type securing devices, also know as strap locks, which can be used without excess slack so as to tightly secure an object so that it will not rattle or disengage from the object.

2. State of the Prior Art

The use of sporting equipment securing devices is well known in the prior art. Sporting equipment securing devices typically consist of a cable type device with loops located at both ends used in conjunction with a padlock, a larger U-shaped lock, or an elastic band used to secure equipment during transport. While these locking devices satisfy the basic objective and requirement of securing one object to another, these devices also possess several drawbacks.

A typical cable type securing device consists of a fixed length cable with a loop located at each end. A padlock is typically passed through each loop and locked to secure the ends. In use, the cable is wrapped around a portion of the sporting equipment, for example a bicycle frame, as well as a locking structure such as a bicycle rack. The cable is wrapped repeatedly around the bicycle frame and rack until the slack in the cable is eliminated. As the loops are separated by a cable having a fixed length, an exact cable locking length between the frame and the rack is difficult to achieve. Oftentimes, it is impossible to eliminate all of the excess slack. This can prove to be troublesome in situations when a user has secured a bicycle to a rack mounted on an automobile. The excess slack could cause the bicycle to become dislodged from the rack and damaged during transport.

A U-shaped lock has also been used for the purpose of locking sporting equipment. Typically, these devices consist of a heavy U-shaped piece which may be lockingly connected to a straight piece. In use, the bicycle frame is placed proximate a bicycle rack, or perhaps a signpost. Next, the frame and the rack or signpost are encircled on three sides by the U-shaped piece and on the final side by the straight piece. The two pieces are then locked together. To store the U-shaped lock onto the bicycle, the lock is typically inserted into a separate storing rack attached to the bicycle frame or simply hung over a handlebar. As the lock is not securely attached to the frame, the lock is subject to rattling and may fall off as the bicycle is used. In addition, as the U-shaped lock possesses a relatively small fixed geometric configuration, it cannot serve the purpose of securing sporting equipment to a rack mounted on an automobile. Thus, although the U-shaped lock serves as an anti-theft device, a separate device is required to secure a piece of equipment for transport.

The problem of securing a piece of sporting equipment, without excess slack, to a transport rack has been solved to some extent through the use of elastic bands having engaging hooks located at each end. In use, the elastic band is wrapped around the bicycle frame and the rack and then secured by joining the hooks. The elastic nature of the band allows the user to stretch the band while wrapping around the frame and rack thus eliminating any excess slack. However, these elastic bands are generally easily disengaged and thus fail to serve as an anti-theft device.

Hence, it is apparent that a continuing need exists for a variably sized sporting equipment securing device which is lightweight and which may be exactly sized not only to remove excess slack but also to securely store the device onto the sporting equipment.

SUMMARY OF THE INVENTION

The present invention is directed to a strap lock for locking sporting equipment including both a flexible strap and a lock device capable of holding the strap. The lock device has first and second relatively movable members that can frictionally engage the strap while the strap is in a loop form. The strap can thus be adjusted to the appropriate length before the closing of the lock device. Preferably the strap has a plurality of raised portions that are raised relative to other portions of the strap for providing resistance to slipping when the strap is held between the first and second relatively movable members.

The raised portions could comprise ridges that extend transversely of the strap.

The strap preferably comprises a chain, with the raised portions being formed by links of the chain that are of a greater size than other links of the chain. The chain is preferably made of stainless steel.

The chain is further preferably formed by a plurality of link bars and link wires. For each bar, a wire has one end welded to one end of the bar, a spiral looped around the bar toward the other end, and is then welded at the other end to the same bar. The next bar is nested within the loops formed on the first bar, with a similar wire being welded to the second bar. This is repeated so that the link loops of each bar have three further bars nested therein. The link loops alternate in direction such that they form an alternating herring bone pattern. The welds are provided so that they are located below the surfaces of the strap formed by the links so as to not to interfere with the engagement of the opposite surfaces of the strap by the lock device.

The flexible strap is preferably provided with a covering to prevent damage to the sporting equipment being locked by the flexible strap itself This covering may be an elongate tube of woven material that is stretched over the stainless steel chain. Preferably the elongate tube is stretchable in the transverse direction of the tube, while maintaining its length and being non-stretchable in the longitudinal direction of the flexible strap, perpendicular to the transverse direction. Thus, the tube is formed to be unidirectionally elastic. Alternately, the covering may comprise a coating such as a plastic coating that is sprayed or formed on the flexible strap.

The lock device itself may include a first lock body member and a second lock body member pivoted to the first lock body member at a first side thereof so as to be relatively movable between open and closed positions. A lock is provided for locking the first and second lock body members in the closed position. The first lock body member and the second lock body member comprise strap engagement portions for holding the strap between them in the closed position. The first and second lock body members also comprise respective member engagement portions at a second side of the first lock body member and the second lock body member for securing the first lock body member to the second lock body member in the closed position.

The strap engagement portions are preferably positioned between the member engagement portion and the first side in which the second lock body member is pivoted to the first lock body member. Further, the member engagement portions preferably comprise at least one projection on one of the lock body members and a recess for receiving the at least one projection on the other of the lock body members. The recesses and projections can include slots on one of the members and corresponding teeth on the other of the members that are positioned on opposite sides of the strap.

Further, the recesses and teeth are preferably angled with respect to the direction of extent of the strap. A pivot pin on one of the lock body members is received in a pivot slot on the other of the lock body members. The pivot slot is angled at the same angle. Thus, when the lock is closed, the lock slides into the final closed position by movement of the teeth into the recesses and the pivot pin along the pivot slot at the same angle.

According to another preferred feature of the present invention, the lock is self locking. It is positioned and arranged so that when the first and second lock body members move to the closed position, the lock automatically locks the two members with respect to each other.

According to a feature of the present invention, a post is provided on one end of the strap. The post is received in a post chamber in the lock device so that the strap can be removably engaged at one end with the lock device. The flexible strap has a free end that can be moved around and inserted between the first and second relatively movable members so as to be held therebetween. According to a further preferred feature, the post has a slot therein that is sized to receive the strap, whereby the lock device can be used by threading the free end of the strap through the slot in the post so as to form a loop, and securing the lock on the free end outside of the loop.

According to another preferred form of the invention, the strap may comprise two separate strap portions extending from the post. Thus, two separate strap portions having respective free ends are provided, whereby two separate loops can be formed and locked between the first and second relatively movable members of the lock device.

BRIEF DESCRIPTION OF THE DRAWINGS

The strap lock according to the present invention will be described below in detail with reference to preferred embodiments thereof and in conjunction with the attached drawing Figures, in which.

DETAILED DESCRIPTION OF THE PREFERRED EMBODIMENTS

Figure 1:
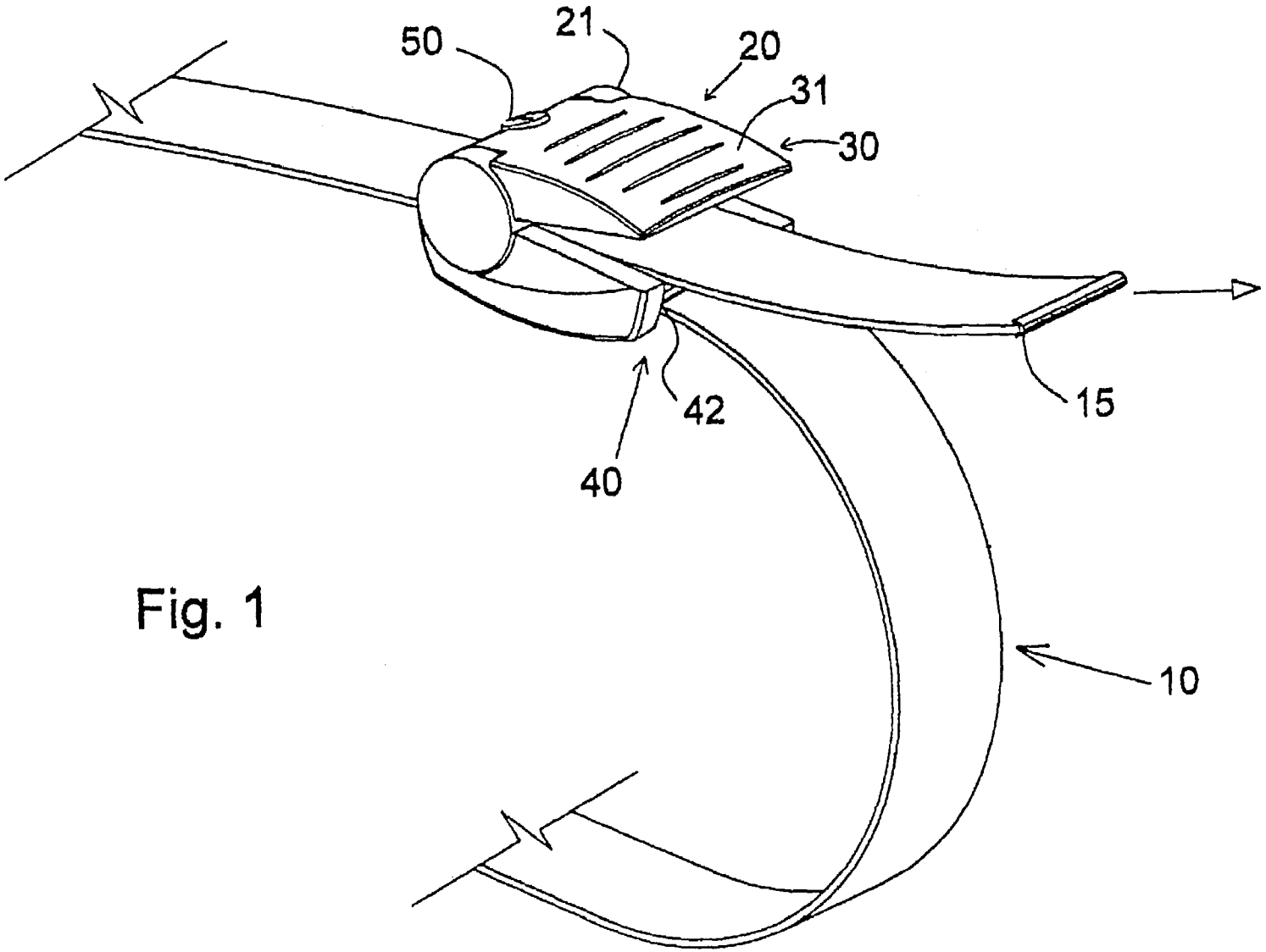
FIG. 1 is a perspective schematic and partly cut away view of a strap lock according to a first embodiment of the present invention.

Referring first to FIGS. 1–8C, a first embodiment of a strap lock according the present invention will be described.

Primary concepts of the present invention involve the use of a flexible but durable strap in locking an object such as a bicycle to another object such as a pole or a bicycle rack. In accordance with an advantageous feature of the present invention, the strap should be able to be tightened so that there is little or no slack in the strap during use. In accordance with a further feature of the present invention, the strap can be replaced with a longer or shorter strap for use with the same locking device.

The strap lock 1 according to the first embodiment includes a strap 10 for use together with a locking device 20.

The locking device 20 includes a lock body 21 which includes a first strap engaging portion 30 and a second strap engaging portion 40. The first strap engaging portion 30 includes a buckle or pivot member 31 that can be pivoted to a closed position (shown for example in FIG. 6) so as to hold the strap 10 in place.

More specifically, a post 14 on an end of the strap 10 is received in a post chamber 41 of the second strap engaging portion 40. The post chamber 41 allows the post 14 to be received therein without going all the way through the second strap engaging portion 40 by the strap 10 having its leading end inserted through a slot 42. The leading end is then continued to be inserted through a channel 33 through the opposite end of the lock body 21.

The leading end of the strap 10 is inserted into the channel 33 while the buckle or pivot member 31 is in its open position and slid through the channel 33 as shown in FIG. 1. The strap 10 is tightened to the appropriate position. The buckle or pivot member 31 is then pushed downward into engagement with the lower part of the lock body 21, which includes the second strap engaging portion 40. The buckle or pivot member 31, together with the lower part of the lock body 21, together form a buckle-type of closure that engages the strap 10 in the closed position to hold it in place. This will explained in more detail.

A lock 50, which can be operated by a key, is positioned at the front end of the lock body 21, being received in the buckle or pivot member 31. After the buckle or pivot member 31 is moved to its closed position, a key can turn the lock to its closed position so that the lock engages the lower part of the lock body 21 to prevent pivotal movement of the buckle or pivot member 31 with respect to the lower part of the lock body 21.

Figure 3:
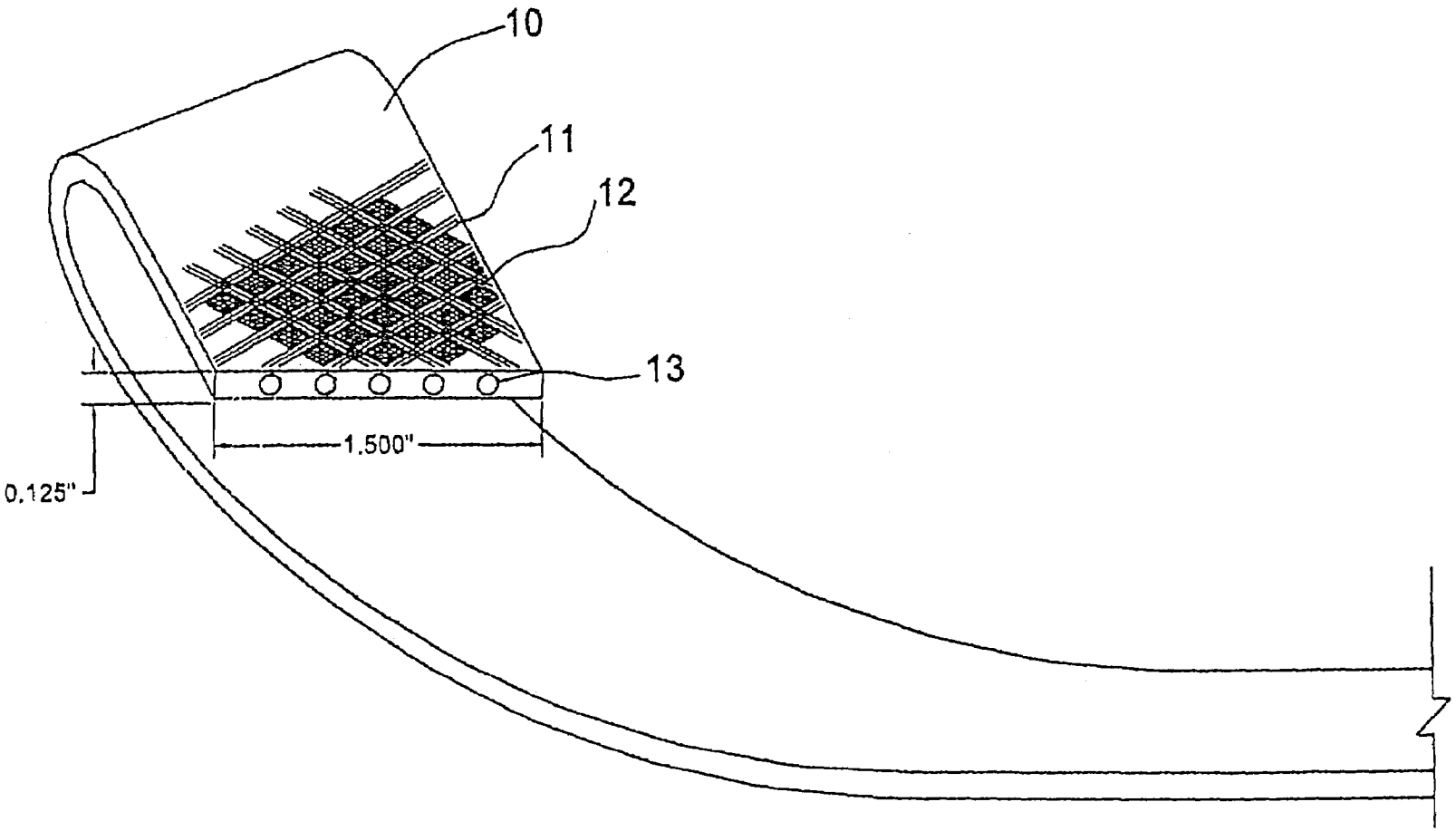
FIG. 3 is a partly perspective and partly cross-sectional view of a strap for use with the strap lock of the first embodiment.
Figure 4:
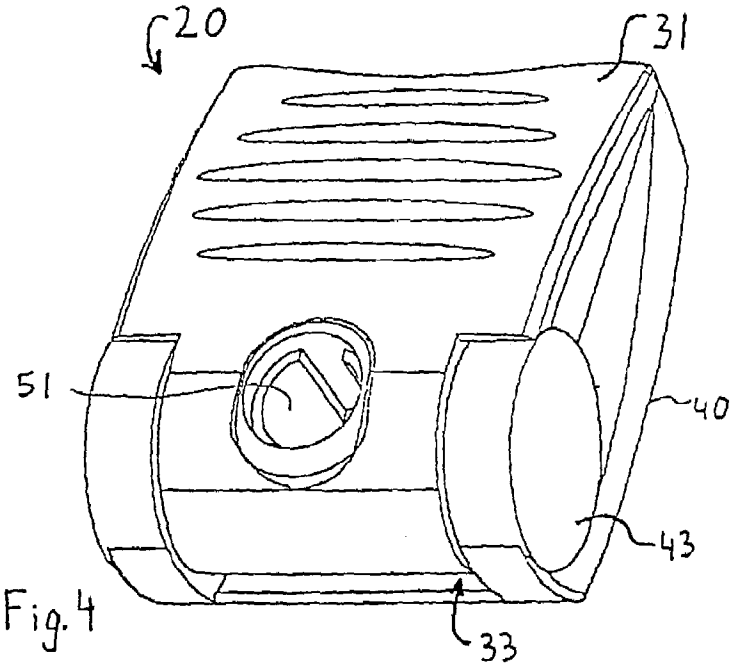
FIG. 4 is a perspective view of a strap lock body for use with a strap lock of the first embodiment.
Figure 7:
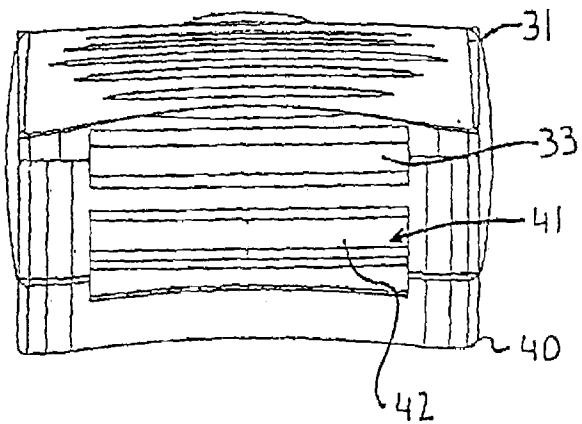
FIG. 7 is a rear end view of the strap lock body of FIG. 4.
Figure 5:
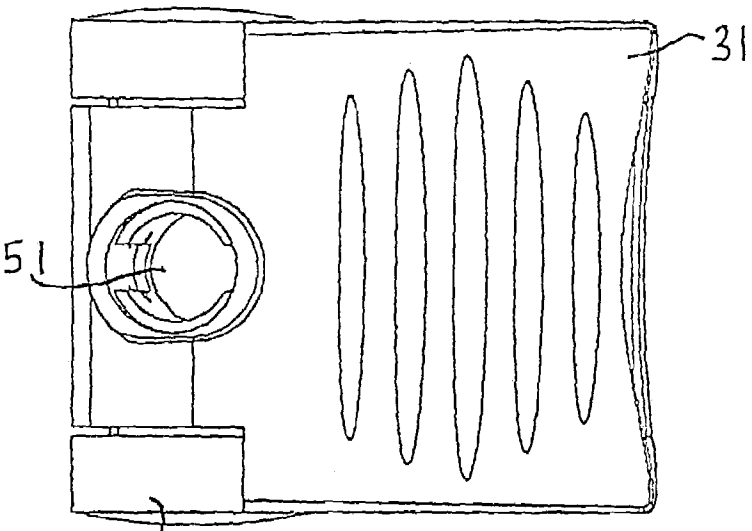
FIG. 5 is a top view of the strap lock body of FIG. 4.
Figure 6:
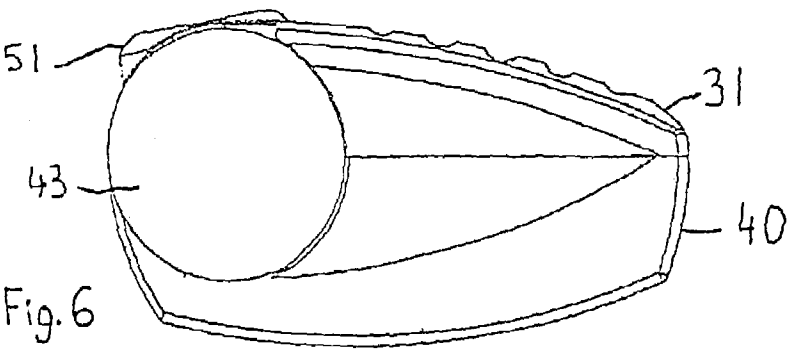
FIG. 6 is a side view of the strap lock body of FIG. 4.

Turning to FIG. 3, the strap 10, according to a further preferred feature of the present invention, is a woven strap made from a combination of metal and plastic materials. Preferably, steel strands 11 are woven with plastic strands 12 to form a woven mesh-like braid. Further preferably, the steel strands 11 and the plastic strands 12 are woven about a core 13.

Weaving a plastic together with steel provides a strength greater than that of the plastic by itself Further, the plastic material makes it more difficult for someone to cut through the steel strands or wires. That is, if someone were trying to cut the strap 10 with a set of cable cutters, the plastic that is integrated with the steel will allow the steel to give a small amount, thus not allowing the strap to be cut through with the cable cutters. If someone attempts to cut the strap 10 with shears, the steel tends to cause the shears to bind.

The plastic and steel woven together forms an outer layer or crust having the core 13. The steel and plastic can be woven together on an appropriate loom so as form a tight mesh while still providing the strap with flexibility and great durability.

The plastic is preferably a high quality and high strength polymer material, and further preferably Kevlar.

The steel strands 11 preferably comprise stainless steel.

The core 13 is preferably a solid metal, and is more preferably a beaded chain. Employing a beaded chain as the core 13, extending axially through the strap and surrounded by the mesh of the woven stainless steel wires and Kevlar wires, for example, allows the strap 10 to remain flexible while further allowing the strap material to have memory. Furthermore, the steel in the plastic and steel weave of the strap 10 forms a bridge between respective balls of the beaded chain in the core 13. This allows the pressure from cutting tools trying to cut the strap 10 to be forced onto the tops of the balls of the beaded chain, instead of into areas in between the balls of the beaded chain. The presence of a beaded chain having such balls in the center of the woven strap 10 makes the strap 10 significantly stronger than without the beaded chain.

Alternatively, instead of a beaded chain, the core 13 could comprise a plain steel mesh. In this instance, it is possible to consider that a similar steel and plastic woven mesh as described above would surround this core, or, possibly just a plastic woven mesh could be provided over the outside of the steel mesh.

In addition to looming or weaving the mesh around the core 13, plastic material for the strap 10 could be injection molded around a steel mesh or solid metal material by placing such metal material within a mold and then injecting the plastic material so as to be formed around the metal material.

The core 13 may also comprise a beaded chain where the beaded chain is a mid gauge "13" beaded chain made of nickel plated stainless steel. It can also be brass covered. One advantage of employing beaded chain is the relative low cost of beaded chain.

According to one example of the strap 10 for use of each of the embodiments disclosed herein, the strap 10 includes 10 strands of 0.01 inch stainless steel, three cords wrapped three times of Kevlar braid, and a core 13 of beaded chain. The Kevlar material is designated 24×3×1500 denier, while the stainless steel material is designated 24×11×30.

The post 14 is preferably made of an aluminum material crimped onto the end of the strap 10. A filler material such as a liquid cement may be included to make sure that there is a solid and complete connection between the post 14 and the strap 10. A similar flat front piece 15 is crimped on to the front end of the strap 10 for insertion through the lock body 21.

The lock body 21 of the locking device 20 includes the first strap engaging portion 30 having the buckle and pivot member 31 and the second strap engaging portion 40 on the lower part of the lock body 21. The lock 50 is provided separately. However, the remainder of the lock body 21 can be formed of cast steel or molded from a synthetic material. Preferably, it is made from a hard plastic material chosen for strength and durability.

Turning now to FIGS. 4–7 details of the lock body 21 and its interaction with the lock 50 will be discussed. The buckle or pivot member 31 is pivoted to the lower part of the lock body 21. Pivots 43, the large round portions on the front end of the lock body 21, are part of the lower portion of the lock body 21, and it is to these pivots 43 that the buckle or pivot member 31 is pivoted. A suitable pivot shaft or shafts will extend from the interior of the end of the buckle or pivot member 31 to the interior of the pivots 43 to allow the buckle or pivot member 31 to pivot thereon.

A lock slot 51 is provided in the buckle or pivot member 31 at the front end for purposes of receiving the lock 50. The lock 50 is, according to this embodiment, a key lock which includes projecting pins for engagement with lock pin slots in the pivots 43. Accordingly, when the lock 50 is in the unlocked position and the key in the lock is turned, the pins thereof will project outwardly from the lock 50 into engagement with the lock pin slots so as to engage the buckle/pivot member 31 with the pivots 43 of the lower portion of the lock body 21. This prevents pivotal movement of the buckle or pivot member 31 with respect to the lower portion, thereby locking the buckle and pivot member 31 in place.

Accordingly, when an object is to be locked to another object, the leading end piece 15 is inserted through the post chamber 31 and the slot 42 until the post 14 is received in the post chamber 41. There is room via the slot 42 for the post 14 to pivot through a number of different angles to allow the strap 10 to take a number of different positions according to the use.

Figure 2:
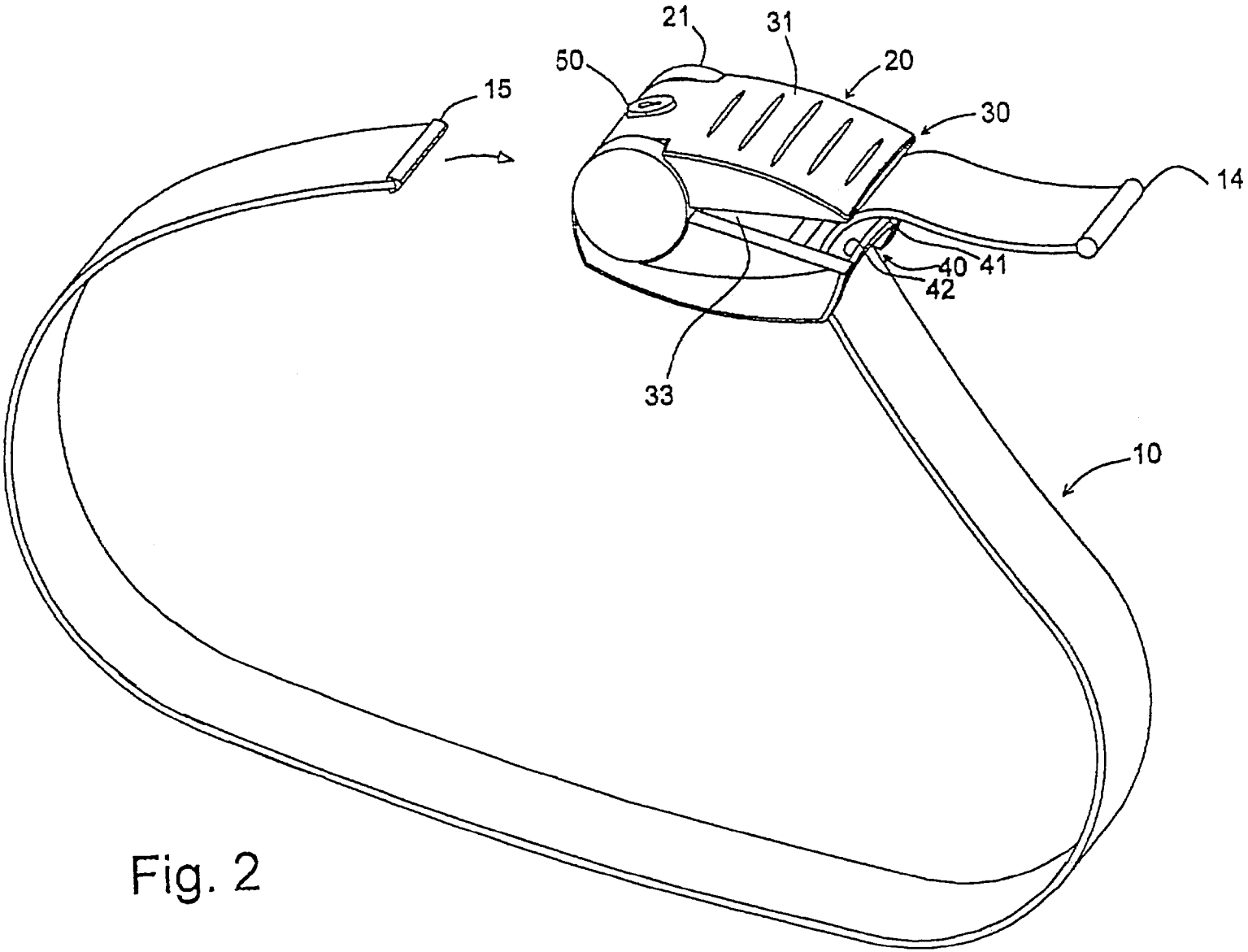
FIG. 2 is a view similar to FIG. 1, showing the strap lock of the first embodiment in the process of assembling the strap lock for use.
Figure 10:
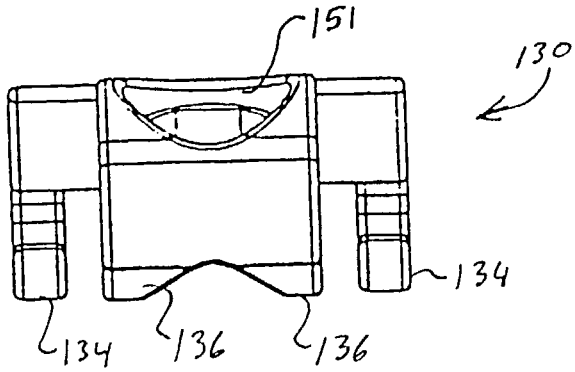
FIG. 10 is a front view of the first lock body member of FIG. 8.
Figure 11:
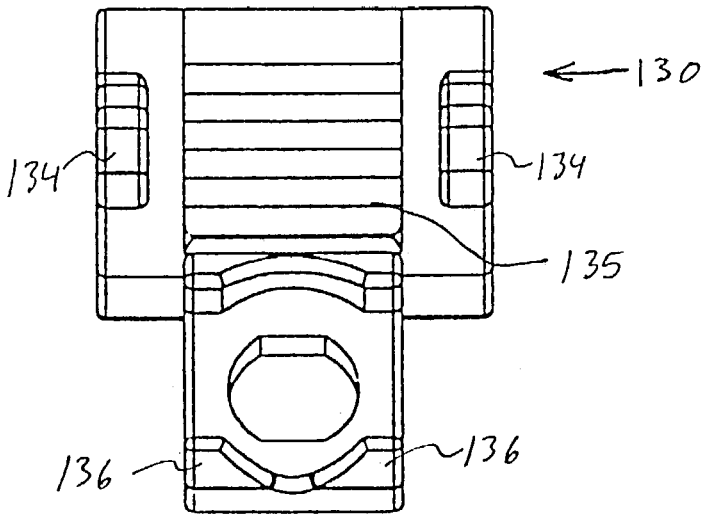
FIG. 11 is a bottom view of the first lock body member of FIG. 8.
Figure 12:
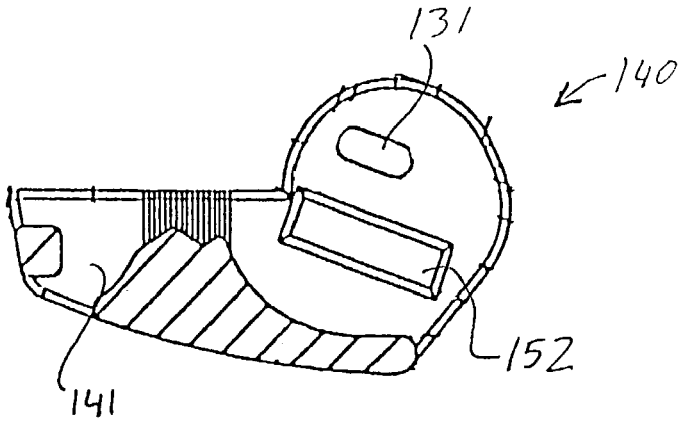
FIG. 12 is a cross sectional view of the second lock body member of FIG. 9.

The piece 15 on the end of the strap 10 is then inserted into the channel 33 (see FIG. 2). The buckle or pivot member 31, in the open position, is raised to allow the strap 10 to be received through the channel 33 and out the right side above the post chamber 41, as can be partly seen from FIG. 10 and as further illustrated in FIG. 1. After the strap 10 has been tightened the appropriate amount, the buckle or pivot member 31 is closed to bring a holding member into engagement with the strap to hold the strap between the holding member and the lower portion of the lock body 21. The holding member can include a number of different arrangements. According to a preferred feature, it is includes a knurled surface that clamps the strap 10 against a similar knurled surface opposite thereto to firmly hold the strap 10 in place inside the lock body 21 in the closed position of the buckle or pivot member 31.

After the buckle or pivot member 31 has reached the closed position and the holding member 32 has engaged the strap 10 to hold the strap 10 in the channel 33 by friction contact or otherwise, a key is turned in the lock 50 to engage the pins of the lock 50 with the lock pin slots. At this point, then, the strap lock is in the locked position. Any leftover portion of the strap 10 will jut out of the right-hand side (as seen in FIG. 1) of the lock body 21 above the post chamber 41. Further, in the closed position the buckle or pivot member 31 closes down above the post chamber 41, preventing the post 14 from becoming removed therefrom.

FIGS. 8–12 illustrate a second embodiment of the lock device according to the present invention. Portions, materials and operation of this and further embodiments are the same as the first embodiment unless described otherwise. In the second embodiment, the first and second lock body members of the lock device have respective member engagement portions at one side thereof in order to further secure the two members together. Thus, in addition to being connected at the pivot connection at one end of the lock device, they are also connected by these engagement portions at the other side thereof. This makes it more difficult to pry the lock apart, thus making it more secure.

Specifically, a first lock body member 130 includes teeth 134 as member engagement portions. The teeth 134 are provided on either side of the member so as to have the strap positioned therebetween in operation. A lock slot 151 is provided in a similar fashion to the first embodiment.

A second lock body member 140 includes a pivot slot 131 for receiving a pivot pin that extends between the first and second lock body members 130 and 140. Thus, the member 130 pivots on the member 140 by the pin extending from the member 130 into the slot 131.

A slot 152 is provided below the pivot slot 131 for receiving the engaging part of a lock when the lock is engaged. The lock can be similar to that of the first embodiment. The lock may include a dead bolt style lock which, upon operation of a key, moves a bolt into the lock slots 152.

Upon closure of the first lock body member 130 with respect to the second lock body member 140, the teeth 134 engage slots 144, and slide back into the slots 144. The first lock body member can thus pivot and slide back into position because of the pivot slot 131 and the slots 134, then enabling the locking of the two together. The fact of the pivot pin connection and the lock engaging the lock slots 152, along with the teeth 134 engaging the slots 144, locks the two together at both ends thereof. This makes it much more difficult for anyone to try and attempt to pry the lock device apart. In order to open the lock, the procedure is reversed. That is, the lock is disengaged by turning the key, for example, and then the first lock body member 130 is slid forward and pivoted to disengage the teeth 134 from the slots 144.

Reference number 145 represents a strap engagement part, which has a corresponding engagement part 135 on the first lock body member 130. Post chamber 141, for receiving the post of the strap, is similar to the first embodiment.

Figure 8:
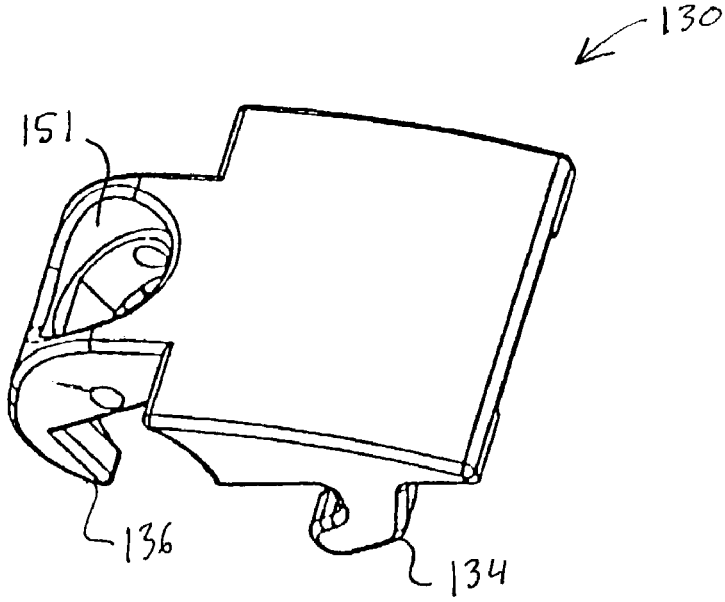
FIG. 8 is a perspective view of a first lock body member according to second embodiment of the locking device.
Figure 9:
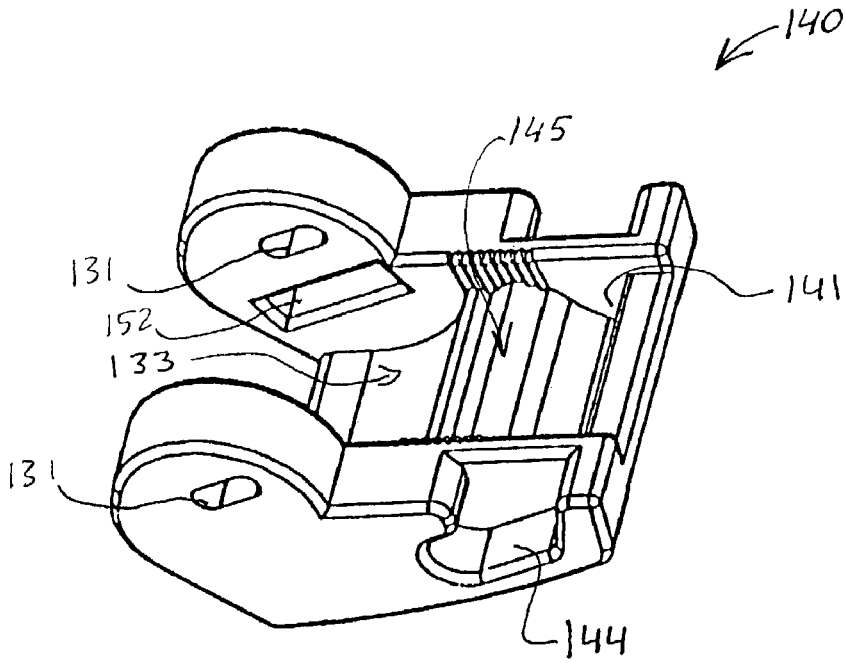
FIG. 9 is a perspective view of a second lock body member of the second embodiment.

The distal end of the first lock body member 130 has two distal portions 136 that curve downward as seen in FIG. 8. These portions helps grip the strap upon closure of the first lock body member 130 with respect to the second lock body member 140.

As noted above, the lock may be of any type of lock that can be used for this type of operation, including a dead bolt style lock, as well as a cam lock.

FIGS. 13A–15 and FIGS. 31 and 32 illustrate a further embodiment of the strap according to the present invention. The strap is designated by reference number 110, and is most readily seen by reference to FIG. 32.

This embodiment of the strap, in contrast to the first embodiment, is composed of a metal chain, preferably stainless steel. The strap has a post at one end, similar to the other embodiments of this strap, and a simple end member at the other end, also similar to the other embodiments. The chain itself is in a herring bone pattern. The structure and arrangement of the chain, and especially when employed with stainless steel, provides excellent strength and resistance to cutting while maintaining flexibility.

The chain is formed by two primary elements, link bars (111*a* and 111*b*) and link loops (112*a* and 112*b*). The link bars are metal bars that extend transverse to the longitudinal direction of the strap and serve as a base for each set of links. The link loops are wires that extend from one end of each bar to the opposite end. This will be discussed in more detail with reference to FIGS. 13A–15.

A first link bar 111*a* has a link loop (wire) 112*a* welded to one end, looped around the bar itself a number of times in a generally spiral pattern, and welded to the opposite end. The resulting loops should be substantially elongate to extend in the longitudinal direction of the chain. The loops of the link loop 112*a* thus form effectively five loops as illustrated, having an upper loop part and a lower loop part as illustrated. The upper loop parts form an upper surface of the chain, and the lower loop parts form a lower surface of the chain. The link bars then are at a position between the upper and lower surfaces of the strap, effectively. The same holds true for the weld connections that weld the ends of the loop 112*a* or 112*b* to the ends of the respective link bars.

Figure 13A:
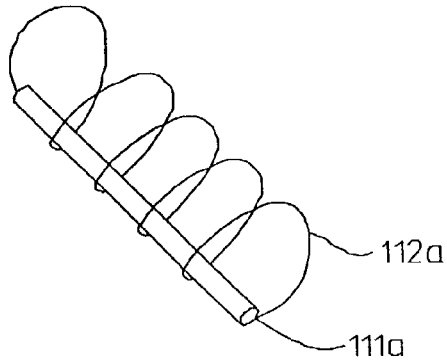
FIG. 13A and FIG. 13B are perspective views illustrating respective links of a strap according to a second embodiment of the present invention.
Figure 13B:
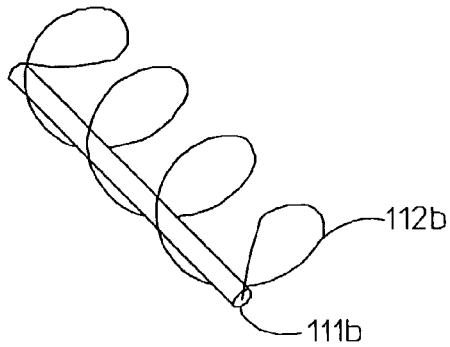
Figure 14:
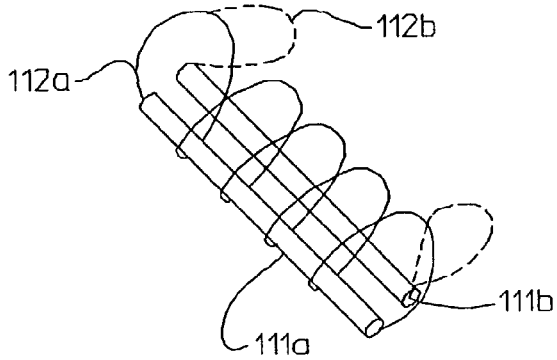
FIG. 14 is a perspective view illustrating a combination of the respective links of FIGS. 13A and 13B.

In FIG. 13A, the link loop 112*a* begins from the upper left end of the link bar 111*a* by extending upward, as seen in the drawing figure, first, and then looping around the bar in the same direction finally to a lower loop at the lower right end. A next subsequent link bar 111*b*, as shown in FIG. 13B begins in the opposite way. That is, the link loop 112*b* extends from the upper left end downward, and then extends upward and around the link bar 111*b* in a spiral pattern continuing in the same way, and ends with an upper link loop at the end. These two are shown together in FIG. 14. In FIG. 14, only the dashed line beginnings at each end of the link bar 111*b*, for the link loop 112*b*, are shown for the sake of simplicity of illustration. By alternating the link bars 111*a* and 111*b* with their corresponding link loops 112*a* and 112*b*, an alternating pattern is formed that results in a herring bone pattern chain.

Figure 15:
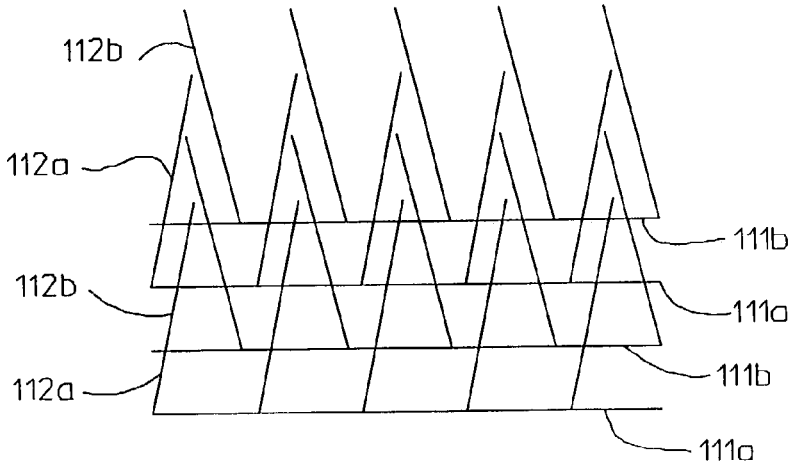
FIG. 15 is a schematic view demonstrating the link structure of the strap according to the second embodiment.

Referring to FIG. 15, it can be seen that one link loop 112*a* will encompass, according to a preferred embodiment, the next three link bars of the chain. Thus, the next subsequent link bar goes in the opposite direction, the second subsequent link bar extends in the same direction, and the third subsequent link bar again extends in the opposite direction, forming the herring bone pattern. In this manner, each link bar encompass the next three bars of the respective link loops, and the chain continues in this fashion until a desired length and end point.

Figure 31:
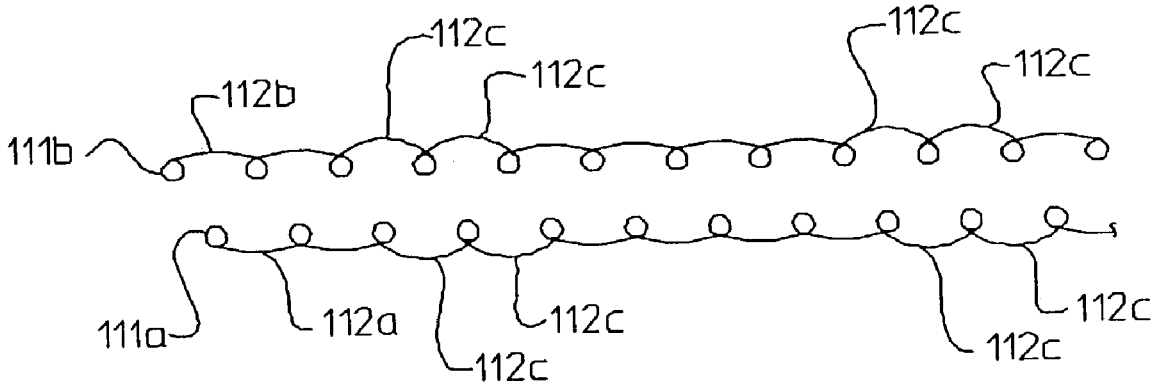
FIG. 31 is a schematic side view illustrating the strap according to the second embodiment, illustrating a preferred feature thereof.
Figure 32:
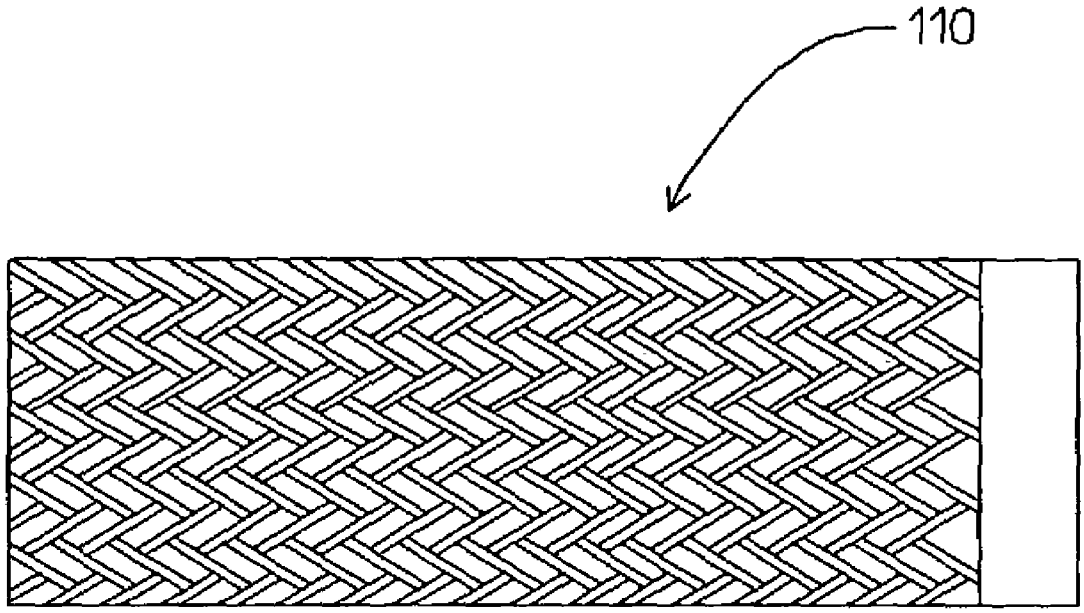
FIG. 32 is a top view of an end part of the strap according to the second embodiment.

As can be seen from FIG. 31, alternating link bars are preferably be positioned slightly vertically separate from each other. In FIG. 31, only the very outer portions of the respective link loops 112*a* and 112*b* are shown for the sake of the simplicity of the illustration. Thus, it can be demonstrated how the link loops 112*a* and 112*b* extending from the respective link bars 111*a* and 111*b* extend relatively flatly a sufficient distance so as to encompass the next three link bars, and then return to their point of origin. A preferable spacing, which is shown in an exaggerated manner in FIG. 31, has the link bars alternating in vertical position slightly. As understood by those of skill in the art, the chain will be relatively tight with respect to the loops winding around the next three respective bars. However, the chain will have sufficient flexibility to allow ready bending around curved objects, such as a bicycle frame. The ends of the chain 110 are welded to the respective post and end member.

As further shown by FIG. 31, periodically spaced along the strap are loops 112*c* that have a slightly greater outward projection than the majority of the loops. Such loops are formed by having the wire forming the loops be of a somewhat greater length than the other loops. The loops are also formed to be rounder. This allows them to project up from the surfaces of the strap so as to form periodic ridges, as shown in the drawing figure. Such periodic ridges, spaced along the strap, are formed so as to provide lateral ridges or ribs along the strap. Such ribs or ridges allow for more effective engagement of the strap by the lock device, and reduce the risk of slipping of the chain through the lock device. While in this embodiment such ribs or ridges are formed by the link loops themselves, such could also be formed by the insertion of separate members through the chain.

The chain may be made by any number of known techniques, including by known machine technology, or manually, or a combination thereof.

Figure 16:
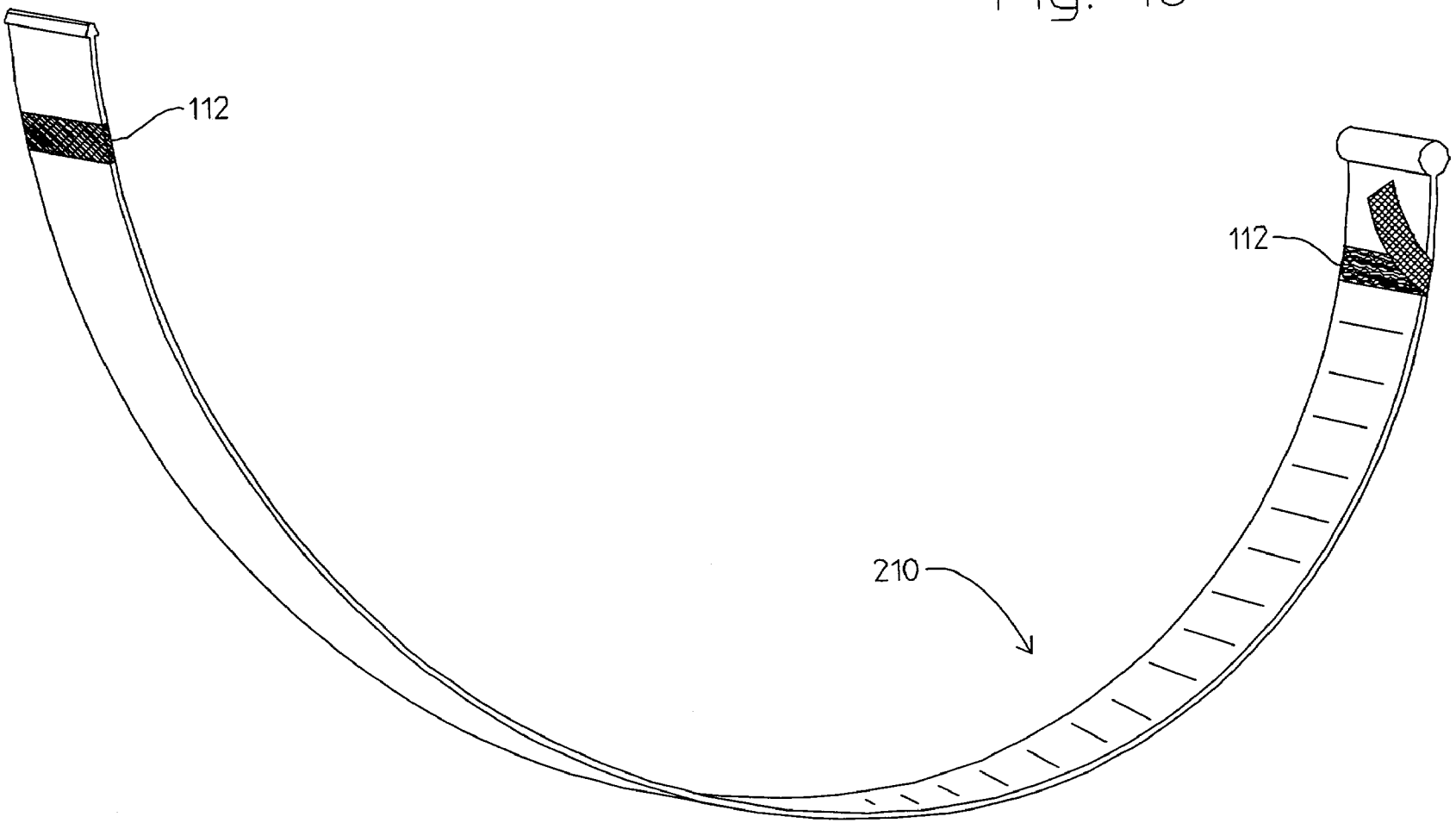
FIG. 16 is a perspective view of the strap including a preferred feature.
Figure 17:
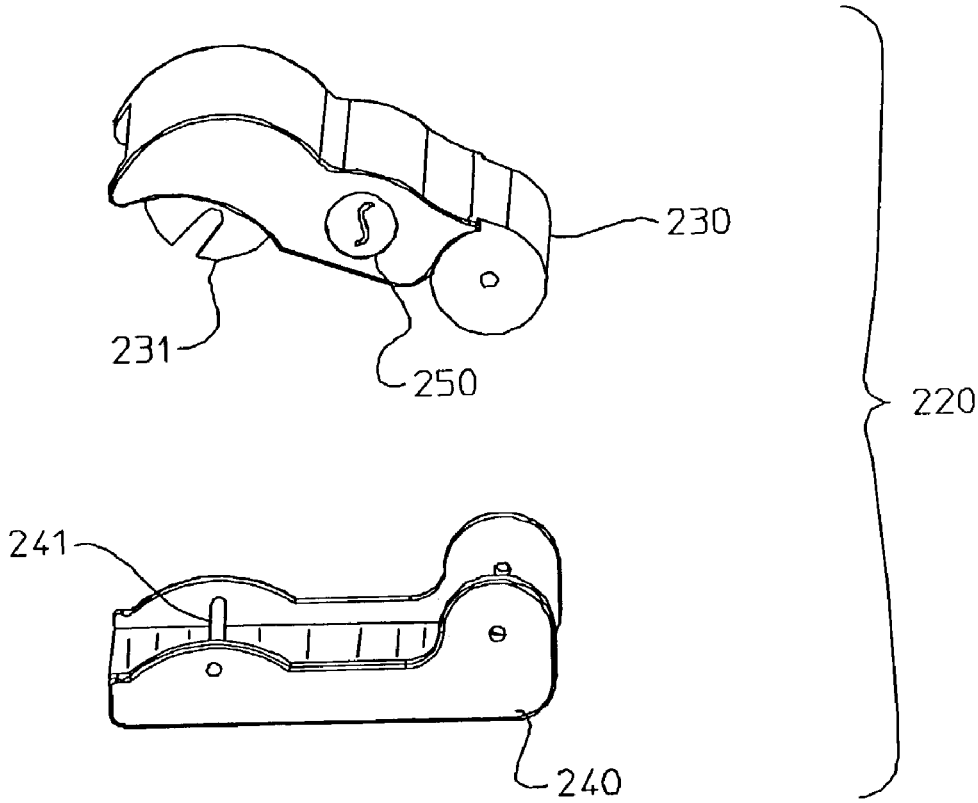
FIG. 17 is a perspective view of first and second lock body members according to a third embodiment of the present invention.

Noting FIG. 16, velcro straps 211 may be provided at opposite ends of a strap 210. Such velcro straps can be used for a number of different purposes, including the securing of a cover to the strap, securing the strap to itself, etc.

FIGS. 17–20 illustrate a further embodiment of the lock device according to the present invention. In this embodiment, the lock is provided so that it can automatically lock itself upon closing, avoiding the extra step of having to turn a key in the lock or provide other appropriate action in order to activate the lock.

Thus, a first lock body member includes a first locking part 231 that is operated along with the lock 250. This first locking part 231 can engage a bar 241 on a second lock body member 240 of the lock device 220.

Figure 18:
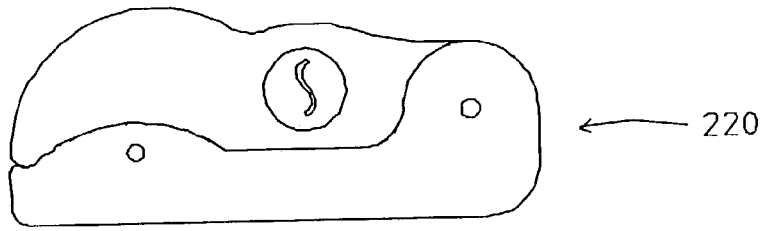
FIG. 18 is a side view of a lock device according to the third embodiment in an open position.
Figure 19:
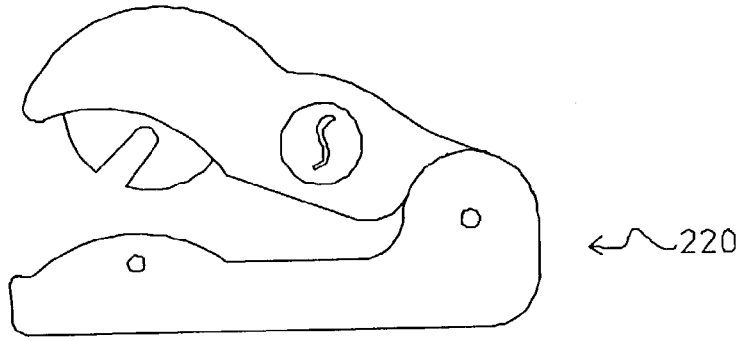
FIG. 19 is a side view of the lock device of the third embodiment in the closed position.
Figure 20:
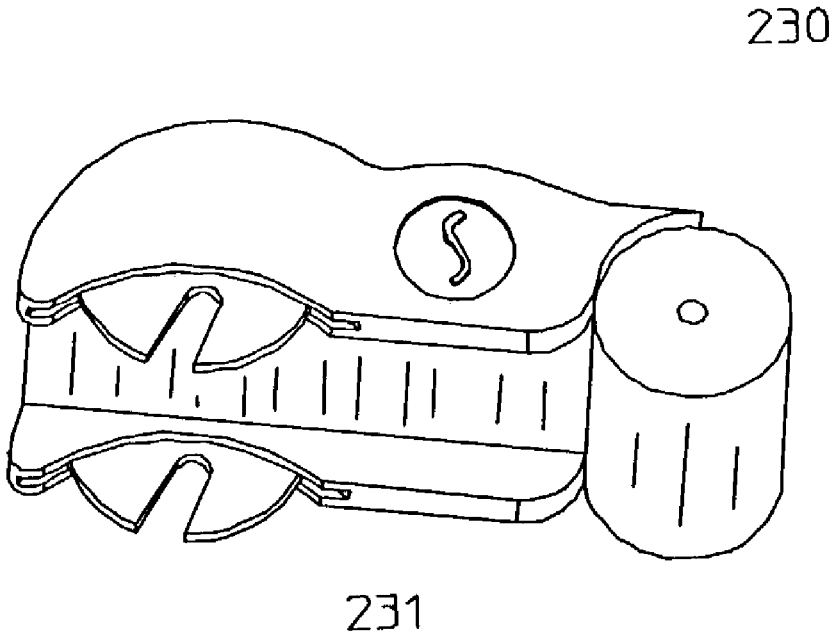
FIG. 20 is a perspective view from the bottom of the first lock body member of the third embodiment.

Thus, upon closing the first lock body member with respect to the second lock body member, as shown in FIGS. 18 and 19, the first part 231 has a slot aligned to receive the bar 241. When the bar is received by the member 231, the member 231 engages the bar and turns and is automatically locked by the lock 250. This operation is similar to the operation of a door lock upon the closing of a car door.

Figure 21:
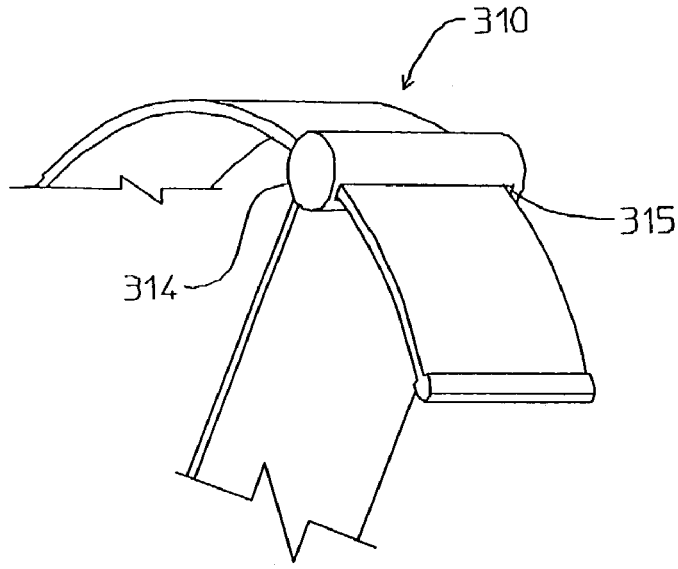
FIG. 21 is a perspective view illustrating a modification of the strap according to the present invention.
Figure 22:
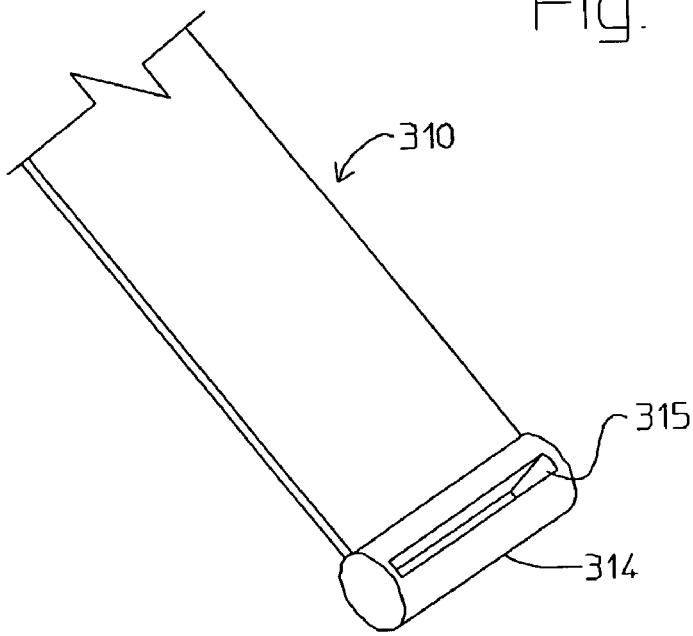
FIG. 22 is a perspective view of a part of FIG. 21.
Figure 23:
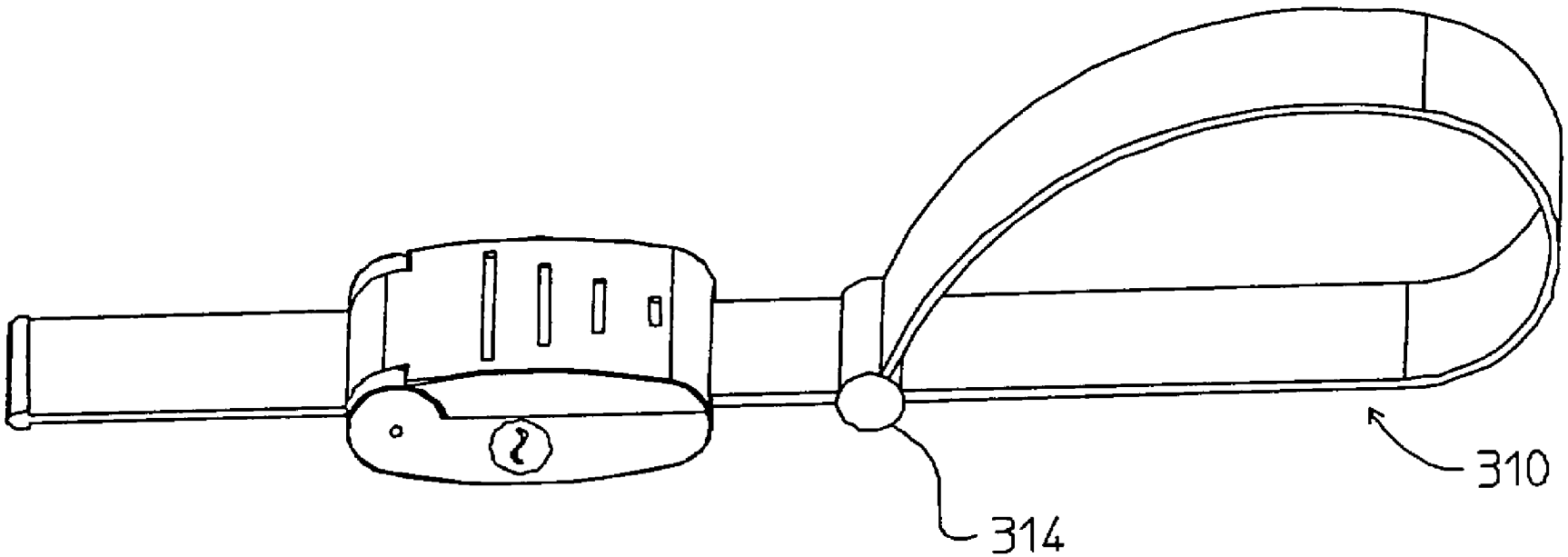
FIG. 23 is a perspective view demonstrating the use of the modification of the strap illustrated in FIGS. 21 and 22.

FIGS. 21–23 illustrate a further embodiment of the strap according to the present invention. A strap 310 according to this embodiment has a post 314 provided with a slot 315. The slot 315 can have a free end of the strap inserted therethrough, thus forming a loop with the strap. As demonstrated by FIG. 23, the strap can then form a loop upon itself, and the lock can be locked on to the strap, with the strap forming a loop for locking an item, without having to engage the post 314 with the lock device itself.

Figure 24A:
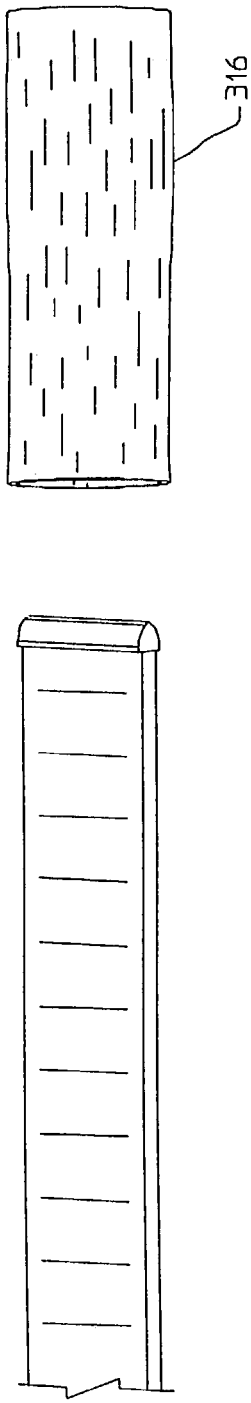
FIGS. 24A–24C are perspective views illustrating a cover for the strap.
Figure 24B:
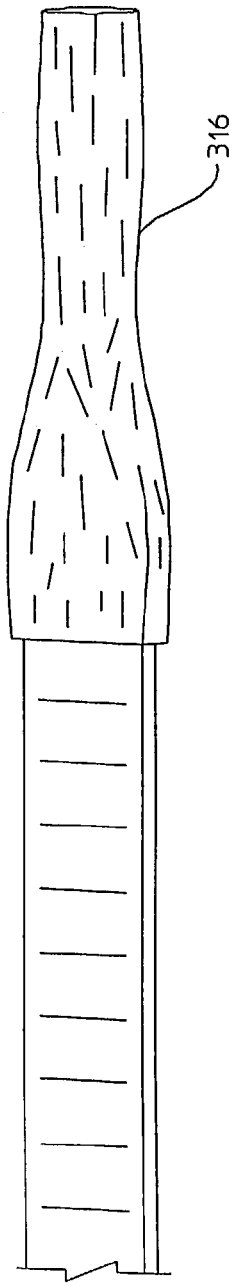
Figure 24C:
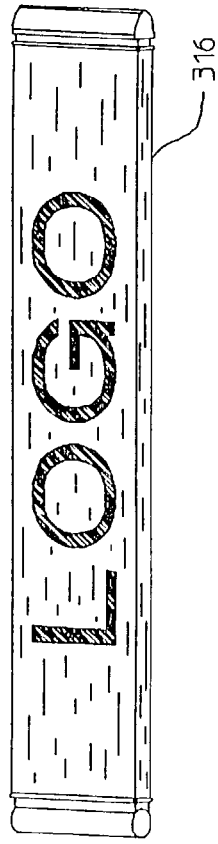

According to a further feature according to the present invention as illustrated by FIGS. 24A–24C, a cover 316 may be provided for the strap according to any of the embodiments of the present invention. The cover is preferably an elastic tube of woven material, suitably selected so as to be capable of covering the strap and preventing the strap, made for example of stainless steel chain, from scratching a piece of sports equipment being locked. According to a preferred feature, the elastic tube 316 is woven from a material that is elastic in a direction lateral to the longitudinal direction of the strap, but non stretchable in the longitudinal direction. Such materials are per se well known to those of skill in the art. Such material allows the strap to be snugly engaged by the elastic covering tube while at the same time ensuring sufficient length of the tube to cover the entire strap.

As can be seen from FIG. 24C an appropriate logo can be provided on the covering tube 316.

Alternatively, the covering may be provided by a coating on the length of the strap, such as a plastic coating. Plastic coating could be sprayed or otherwise formed on the flexible strap. Preferably, plastic coating could be extruded on the length of the strap.

Figure 25:
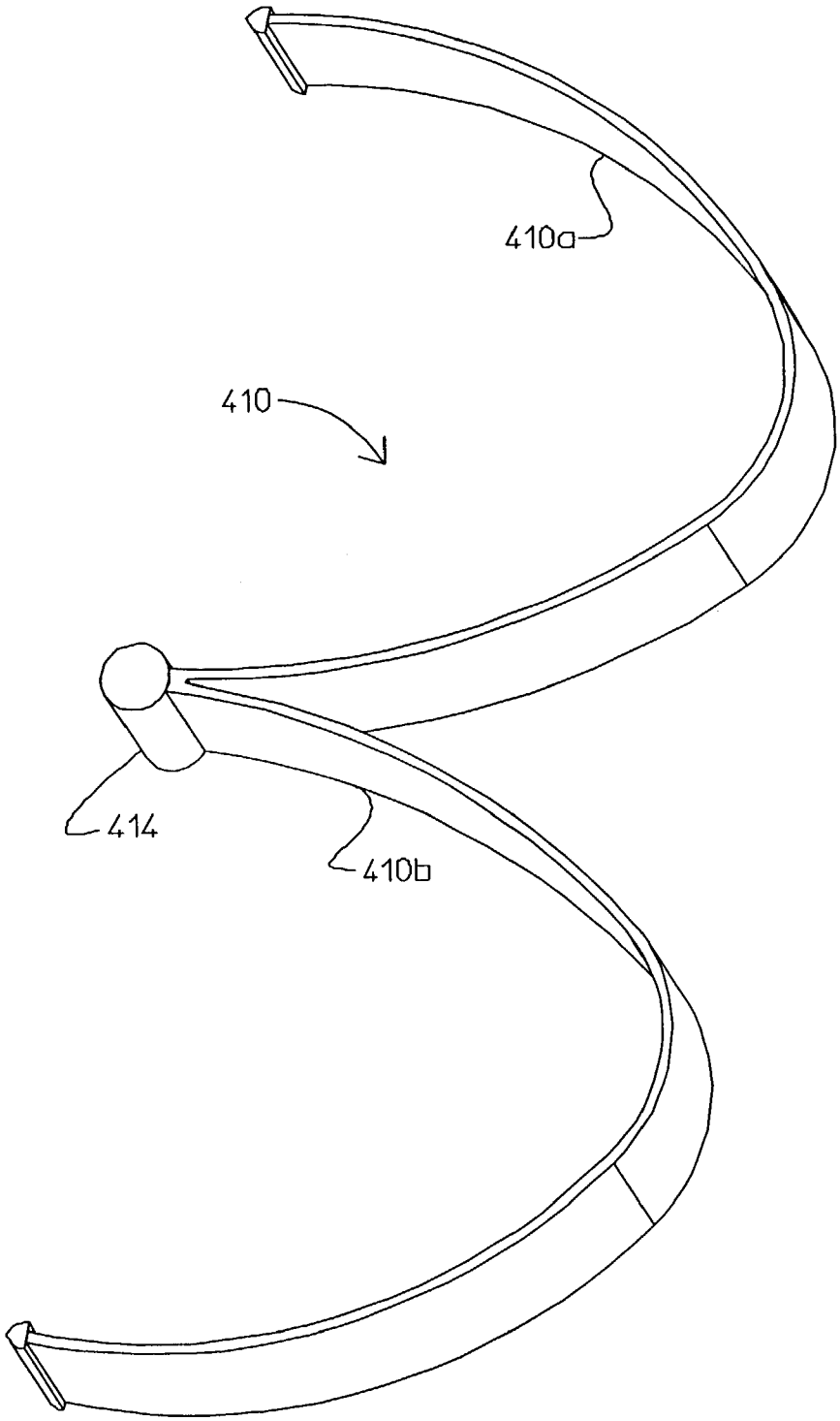
FIG. 25 is a perspective view of a further variation of the strap according to the present invention.
Figure 26:
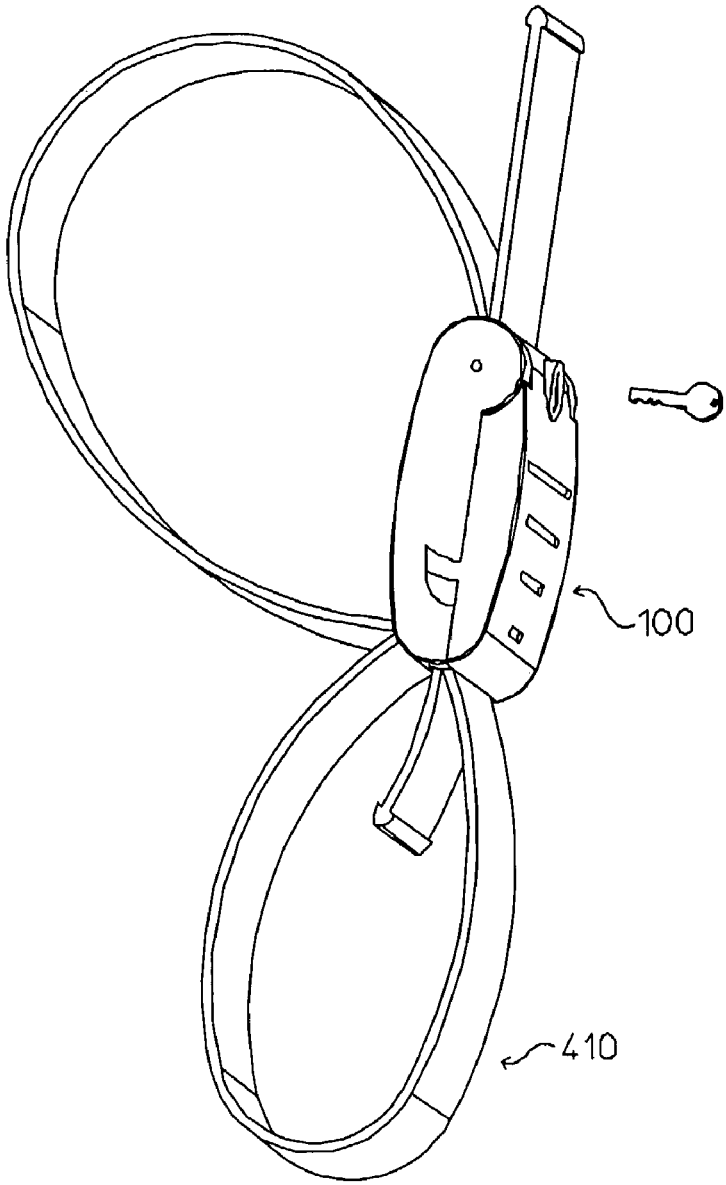
FIG. 26 is a perspective view illustrating the use of the modification of FIG. 25.
Figure 27:
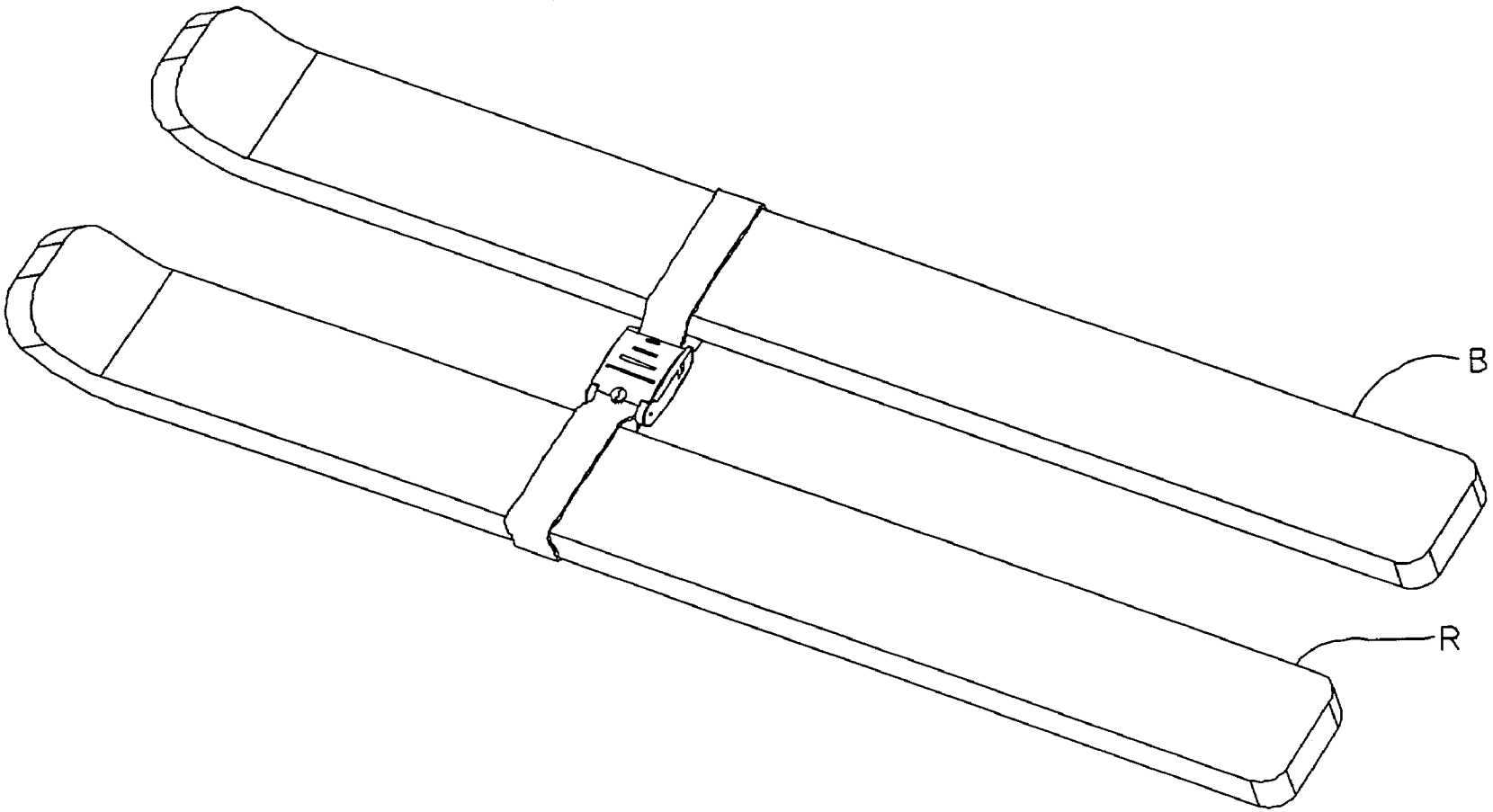
FIG. 27 further demonstrates the use of the modification of FIG. 25.
Figure 28A:
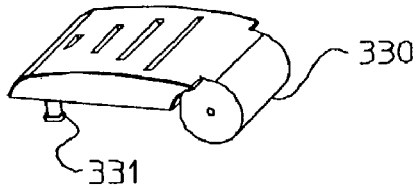
FIGS. 28A and 28B are perspective views illustrating first and second lock body members, respectively, according to a fourth embodiment of the lock device of the present invention.
Figure 29:
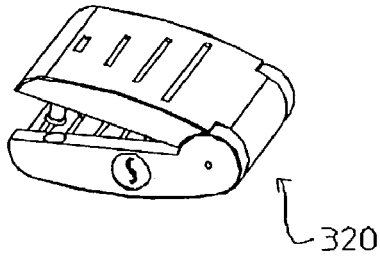
FIG. 29 is a perspective view of the lock device of the fourth embodiment in the open position.
Figure 28B:
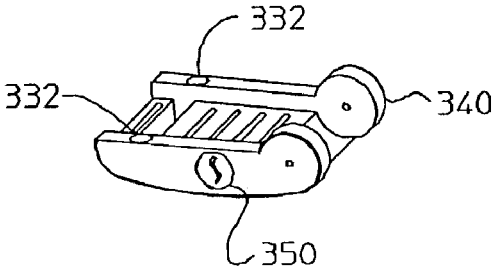
Figure 30:
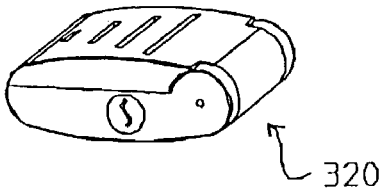
FIG. 30 is a perspective view of the lock device in the fourth embodiment in the closed position.

FIGS. 25–27 represent a further embodiment of the strap according to this invention. In this embodiment a strap 410 has two strap parts 410*a* and 410*b* extending from a single post 414. The two strap portions 410*a* and 410*b* can be made of a stainless steel chain of the type described above, and welded to the post 414.

By having two strap portions 410*a* and 410*b*, two separate loops can be formed and locked by a lock device. A lock device suitable for employment with this particular strap can be any of those described above, including the lock device 100 illustrated in FIG. 26. Thus, with a single post engaged in the post chamber of the lock device 100, one loop can be inserted from one end of the lock device, and the other loop can be inserted from the other end lock device, and both ends of the loop sandwiched together between the respective parts of the lock. This allows two different parts to be looped together at two different points, as for example shown in FIG. 27. In this figure, for example, a bicycle B is locked to a rack R with a lock device in this case being located between them, so that only straps engage each of the bicycle B and rack R.

A further embodiment of the lock device according to the present invention is illustrated in FIGS. 28A–30. This embodiment is a self locking lock device, similar in some respects to that described above. With respect to this embodiment, as with all the embodiments herein, parts not otherwise described are assumed to be the same as with respect to the first embodiment.

In this case, a first lock body member 330 is pivoted with respect to a second lock body member 340 and has tooth portions 331 engaging slots 332 of the second lock body member 340. Projections on the ends of the tooth portions 331 move into the slots 332 and trigger an automatic locking device to engage a pin or a bar that prevents the projection from leaving the slot 332. Only upon operation of the lock thereafter, for example by turning a key in the lock, can the pin or bar of the lock be removed from the path of the projection of the tooth 331 to allow opening of the first lock body member 330. Such types of locks per se are well known, and further description herein is thus not necessary.

While preferred embodiments of the present invention have been described above, it will be apparent to those of ordinary skill in the art that various changes to the specifics thereof may be made within the scope of the present invention.

I claim:

1. A strap lock, comprising:

a flexible strap; and a lock device comprising first and second relatively movable members capable of holding said strap therebetween;

wherein said strap comprises a stainless steel chain composed of a plurality of link bars and wire loops connected with said link bars;

wherein said wire loops have opposite ends permanently fixed to respective ends of respective said link bars.

2. The strap lock of claim 1, wherein said wire loops extend around link bars other than the respective said link bars to which said wire loops are fixed.

3. The strap lock of claim 1, wherein said link bars each have one of said wire loops extending from an end of one of said link bars, looping around adjacent ones of said link bars, and connecting to an opposite end of the one of said link bars.

4. The strap lock of claim 3, wherein a herringbone pattern is formed in said stainless steel chain by said wire loops connected to adjacent said link bars looping in oppositely angled directions.

5. The strap lock of claim 1, wherein said wire loops form upper and lower surfaces of said chain and said link bars are located between said upper and lower surfaces of said chain.

6. A strap lock, comprising:

a flexible strap; and a lock device comprising first and second relatively movable members capable of holding said strap therebetween;

wherein said strap comprises stainless steel; and further comprising a covering on said stainless steel strap, wherein said covering comprises an elongate tube of woven material that is stretched over said stainless steel strap.

7. The strap lock of claim 6, wherein said elongate tube of woven material has a property of being stretchable in a transverse direction of said tube while maintaining the length of said tube in a longitudinal direction perpendicular to the transverse direction.

8. The strap lock of claim 6, wherein said tube is unidirectionally elastic.

9. A strap lock, comprising:

a strap; and a lock body for holding said strap, said lock body comprising:

a first lock body member, a second lock body member pivoted to said first lock body member at a pivot point at a first side of said first lock body member and said second lock body member so as to be relatively movable between open and closed positions, and a lock for locking said first lock body member and second lock body member in said closed position;

wherein said first lock body member and said second lock body member comprise strap engagement portions thereon operable to clamp said strap therebetween in said closed position;

wherein said first lock body member and said second lock body member comprise respective member engagement portions at a second side of said first lock body member and said second lock body member for securing said first lock body member to said second lock body member in said closed position, said respective member engagement portions being longitudinally spaced from said pivot point; and wherein said strap engagement portions are longitudinally spaced from and positioned, between said member engagement portions and said pivot point at which said second lock body member is pivoted to said first lock body member.

10. A strap lock, comprising:

a strap; and a lock body for holding said strap, said lock body comprising:

a first lock body member, a second lock body member pivoted to said first lock body member at a first side of said first lock body member and said second lock body member so as to be relatively movable between open and closed positions, and a lock for locking said first lock body member and second lock body member in said closed position;

wherein said first lock body member and said second lock body member comprise strap engagement portions thereon operable to clamp said strap therebetween in said closed position;

wherein said first lock body member and said second lock body member comprise respective member engagement portions at a second side of said first lock body member and said second lock body member for securing said first lock body member to said second lock body member in said closed position;

wherein said member engagement portions comprise laterally spaced projections on one of said first lock body member and said second lock body member and corresponding laterally spaced recesses for receiving said projections on the other of said first lock body member and said second lock body member; and wherein said first lock body member and said second lock body member are longitudinally movable relative to each other upon pivoting to said closed position to engage said projections in said recesses.

11. A strap lock, comprising:

a strap; and a lock body for holding said strap, said lock body comprising:

a first lock body member, a second lock body member pivoted to said first lock body member at a first side of said first lock body member and said second lock body member so as to be relatively movable between open and closed positions, and a lock for locking said first lock body member and second lock body member in said closed position; wherein said first lock body member and said second lock body member comprise strap engagement portions thereon operable to clamp said strap therebetween in said closed position;

wherein said first lock body member and said second lock body member comprise respective member engagement portions at a second side of said first lock body member and said second lock body member for securing said first lock body member to said second lock body member in said closed position; and wherein:

said at least one projection comprises two projections on said second lock body member;

said at least one recess comprises two recesses on said first lock body member positioned to receive said two projections;

said first lock body member comprises a first strap receiving portion including one of said strap engagement portions, said one of said strap engagement portions including a first roughened surface for engaging said strap;

said second lock body member comprises a second strap receiving portion including a second of said strap engagement portions, said second of said strap engagement portions including a second roughened surface for engaging said strap; and said two projections and said two recesses are positioned such that, when said first lock body member and said second lock body member are in said closed position with said strap extending between said first and second of said strap engagement portions, said strap extends between said two-projections and between said two recesses.

12. The strap lock of claim 10, wherein:

said strap engagement portions are provided such that, when said strap is held thereby, said strap extends between said first lock body member and said second lock body member in a direction of extent;

a pivot slot is provided on one of said first lock body member and said second lock body member, said pivot slot extending at an angle inclined with respect to the direction of extent of said strap;

a pivot pin is provided on the other of said first lock body member and said second lock body member and is received in said pivot slot;

said recesses extend at the angle inclined with respect to the direction of extent of said strap such that when said first lock body member and said second lock body member move to said closed position by relative pivoting, said pivot pin slides in said slot as said projections are received by said recesses and moves into said recesses.

* * * * *